US011208770B2

(12) United States Patent
Mahler et al.

(10) Patent No.: US 11,208,770 B2
(45) Date of Patent: Dec. 28, 2021

(54) SCREED ARRANGEMENT

(71) Applicant: Volvo Construction Equipment AB, Eskilstuna (SE)

(72) Inventors: Anton Mahler, Wennigsen (DE); Bernd Lemke, Moringen (DE)

(73) Assignee: Volvo Construction Equipment AB, Eskilstuna (SE)

( * ) Notice: Subject to any disclaimer, the term of this patent is extended or adjusted under 35 U.S.C. 154(b) by 3 days.

(21) Appl. No.: 16/649,766

(22) PCT Filed: Oct. 6, 2017

(86) PCT No.: PCT/EP2017/075512
§ 371 (c)(1),
(2) Date: Mar. 23, 2020

(87) PCT Pub. No.: WO2019/068344
PCT Pub. Date: Apr. 11, 2019

(65) Prior Publication Data

US 2020/0277742 A1 Sep. 3, 2020

(51) Int. Cl.
*E01C 19/48* (2006.01)

(52) U.S. Cl.
CPC ..... *E01C 19/486* (2013.01); *E01C 19/4873* (2013.01); *E01C 2301/02* (2013.01); *E01C 2301/10* (2013.01); *E01C 2301/16* (2013.01); *E01C 2301/20* (2013.01)

(58) Field of Classification Search
CPC ..... E01C 19/486; E01C 19/4873; E01C 2301/02; E01C 2301/10; E01C 2301/16; E01C 2301/20
USPC ..... 404/118
See application file for complete search history.

(56) References Cited

U.S. PATENT DOCUMENTS 3,992,124 A * 11/1976 Schrader ..... E01C 19/4833 404/118
4,502,913 A * 3/1985 Lechaton ..... H01L 21/3065 204/192.32
6,124,580 A * 9/2000 Nottmeier ..... E01C 19/407 219/618
6,551,018 B2 * 4/2003 Baker ..... E01C 19/407 404/102

(Continued)

FOREIGN PATENT DOCUMENTS

CN 2490202 Y 5/2002
CN 2934337 Y 8/2007

(Continued)

OTHER PUBLICATIONS

International Search Report and Written Opinion of the International Searching Authority, PCT/EP2017/075512, dated Jun. 4, 2018, 8 pages.

(Continued)

*Primary Examiner* — Raymond W Addie
(74) *Attorney, Agent, or Firm* — Sage Patent Group

(57) ABSTRACT

A screed arrangement for a paver machine includes a screed body including a deflector member and a base plate, and an oscillating tamper bar arrangement positioned between the deflector member and the base plate. The screed arrangement further includes a connecting element connecting the oscillating tamper bar arrangement and the screed body to each other.

15 Claims, 3 Drawing Sheets

(56) References Cited

U.S. PATENT DOCUMENTS

| | | | | |
|---|---|---|---|---|
| 6,773,203 | B2 * | 8/2004 | Casters | E01C 19/40 404/101 |
| 7,654,769 | B2 * | 2/2010 | Herrmann | E01C 19/008 404/75 |
| 8,113,738 | B2 * | 2/2012 | Mahler | E01C 19/407 404/95 |
| 10,246,834 | B1 * | 4/2019 | Ellwein | E01C 19/4833 |

FOREIGN PATENT DOCUMENTS

| | | | | |
|---|---|---|---|---|
| CN | 101046083 | A | 10/2007 | |
| CN | 201128869 | Y | 10/2008 | |
| CN | 202416133 | U | 9/2012 | |
| CN | 106192695 | A | 12/2016 | |
| DE | 4139702 | * | 6/1991 | E01C 19/42 |
| DE | 4040029 | C1 | 4/1992 | |
| EP | 2599918 | A1 | 6/2013 | |
| EP | 3135816 | A1 | 3/2017 | |
| JP | 2008121377 | A | 5/2008 | |
| JP | 2009133167 | A | 6/2009 | |

OTHER PUBLICATIONS

Chinese First Office Action dated Mar. 24, 2021 for Chinese Patent Application No. 201780094823.7, 10 pages (including English translation).

* cited by examiner

SCREED ARRANGEMENT

CROSS REFERENCE TO RELATED APPLICATIONS

This application is a 35 U.S.C. § 371 national stage application of PCT International Application No. PCT/EP2017/075512 filed on Oct. 6, 2017, the disclosure and content of which is incorporated by reference herein in its entirety.

TECHNICAL FIELD

The present invention relates to screed arrangement for a paver machine. The invention also relates to a corresponding paver machine comprising such a screed arrangement. The invention is thus applicable on working machines in the form of paver machines arranged to distribute a paving material onto a ground surface.

BACKGROUND

Heavy vehicles in the form of paver machines have historically been used for distributing a paving material onto a road surface. In particular, the paver machine is used when laying e.g. asphalt or concrete on roads, bridges, etc. The paver machine thus provides the asphalt/concrete onto the ground surface. Hereby, the paver machine performs distribution of the asphalt/concrete as well as an initial compacting of the material. Thereafter, a road roller preferably performs finalized compacting of the asphalt/concrete material.

With regards to the paver machine, a commonly used technology for distribution and initial compacting is to use a so called screed arrangement located at the rear end of the paver machine. The screed arrangement comprises a deflector member, an oscillating tamper bar arrangement and a base plate, wherein the oscillating tamper bar arrangement is positioned between the deflector member and the base plate.

During operation the paving material is firstly provided into a hopper of the paver machine from e.g. a dump truck or the like. The paving material is thereafter provided from the hopper to the screed arrangement. In detail, the paving material arrives at the deflector member which forces it downwards towards an underside of the screed arrangement. The oscillating tamper bar arrangement thereafter performs initial compacting of the paving material, where after the base plate provide finale compacting and distribution.

A problem with the above described screed arrangement is that the oscillating tamper bar arrangement is positioned in a gap between the deflector member and the base plate. This will generate rattle in the screed arrangement as the oscillating tamper bar arrangement hits the deflector member and the base plate during use in the relatively harsh environment of operation. There is thus a desire to improve the screed arrangement for reducing rattle therein, which in turn will increase the operational lifetime of the screed arrangement components.

SUMMARY

It is an object of the present invention to provide a screed arrangement which at least partially overcomes the above described deficiencies. This is achieved by a screed arrangement according to claim 1.

According to a first aspect of the present invention, there is provided a screed arrangement for a paver machine, the screed arrangement being configured to distribute a paving material onto a ground surface, wherein the screed arrangement comprises a screed body comprising a deflector member arranged to receive and distribute paving material provided from the paver machine, and a base plate for forming an even ground surface of the paving material; and an oscillating tamper bar arrangement positioned between the deflector member and the base plate and configured to compact the paving material; wherein the screed arrangement further comprises a connecting element connecting the oscillating tamper bar arrangement and the screed body to each other, the connecting element being connected to the oscillating tamper bar arrangement in the vicinity of a gap formed between the deflector member and the base plate.

The paver machine should be understood to mean a machine which is able to receive and distribute a paving material onto the ground surface. The paving material may, for example, be asphalt or concrete, etc.

Moreover, the oscillating tamper bar arrangement may preferably be eccentrically connected to e.g. a tamper operator or the like. Such tamper operator may preferably be a motor which is arranged to control the tamper bar arrangement to perform the oscillating movement.

Furthermore, the wording "in the vicinity of" should be construed as within a vertical distance from the gap such as to sufficiently prevent horizontal movements of the oscillating tamper bar arrangement. Example embodiments of the position of the connecting element will be described further below.

The present invention is based on the insight that by connecting the connecting element between to the screed body as well as to the oscillating tamper bar arrangement in the vicinity of the gap formed between the deflector member and the base plate is that a relative horizontal movement between the oscillating tamper bar arrangement and the screed body will be substantially prevented. The connecting element is thus preferably fixedly connected to e.g. the base plate of the screed body as well as to the oscillating tamper bar arrangement. An advantage is thus that rattle in the screed arrangement is reduced. Also, the operational life time of the deflector member, the oscillating tamper bar arrangement and the base plate will be increased as wear thereof is reduced.

According to an example embodiment, the connecting element may be connected to the base plate of the screed body. The base plate may be formed as a stiff portion of the screed body which may thus suitably absorb the loads generated in the oscillating tamper bar arrangement during operation.

According to an example embodiment, the base plate may comprise a first surface that, during use, is arranged to face the ground surface, and a second surface arranged to face away from the ground surface, wherein the connecting element is connected to the second surface of the base plate. Hereby, the connecting element is not intervening with the initial compacting and distribution of the screed arrangement.

According to an example embodiment, the connecting element may be connected to the tamper bar arrangement at a position in the vicinity of the second surface of the base plate.

Hereby, the connecting element may be designed as a substantially horizontal bar which allows the oscillating movement of the oscillating tamper bar arrangement while preventing a mutual horizontal movement between the oscillating tamper bar arrangement and the base plate.

According to an example embodiment, the connecting element may be connected to the tamper bar arrangement at a distance less than 85 millimeters, preferably less than 75 millimeters, and most preferably less than 65 millimeters from the second surface of the base plate.

The distance between the connection point on the tamper bar arrangement and the second surface of the base plate should be construed as a mean position during oscillation of the tamper bar arrangement. The tamper bar arrangement may preferably oscillate with an amplitude of e.g. 2-4 mm, whereby the above described distances may vary between ±1-2 mm when the tamper bar oscillates.

According to an example embodiment, the tamper bar arrangement may comprise a compacting surface, which compacting surface is arranged at a lower portion of the tamper bar arrangement and arranged to face the ground surface during use thereof, wherein the connecting element may be connected to the tamper bar arrangement at a distance less than 100 millimeters, preferably less than 85 millimeters, and most preferably less than 75 millimeters from the compacting surface.

Preferably, the thickness of the base plate is 10-15 mm. Hence, when positioning the connecting element to the oscillating tamper bar arrangement using the above described embodiments, the preferred thickness of the base plate should be kept in mind.

According to an example embodiment, the connecting element may be arranged in a substantially longitudinal direction between the oscillating tamper bar arrangement and the base plate, wherein the stiffness of the connecting element is larger in the longitudinal direction in comparison to the direction of motion of the oscillating tamper bar arrangement. The wording "substantially longitudinal direction" should be construed as also include slight variations from the longitudinal direction.

According to an example embodiment, the stiffness in the substantially longitudinal direction may be at least 100 times larger than the stiffness in the direction of motion of the oscillating tamper bar arrangement.

Hereby, a relative vertical movement between the oscillating tamper bar arrangement and the base plate will be allowed, while a relative horizontal movement will be prevented.

According to an example embodiment, the connecting element may be a flat spring element allowing a mutual motion between the oscillating tamper bar arrangement and the screed body in the direction of the oscillating movement of the oscillating tamper bar arrangement, while substantially preventing a mutual motion in a longitudinal direction of the flat spring element.

A flat spring is rather simple in design and provides a cost efficient solution.

According to an example embodiment, the oscillating tamper bar arrangement may comprise a single oscillating tamper bar.

According to an example embodiment, the oscillating tamper bar arrangement may comprise dual oscillating tamper bars.

According to a second aspect, there is provided a paver vehicle arranged to provide a paving material onto a ground surface, the paver vehicle comprising a screed arrangement according to any one of the example embodiments described above in relation to the first aspect for distributing the paving material onto the ground surface.

Effects and features of the second aspect are largely analogous to those described above in relation to the first aspect. Hence, features of the screed arrangement described above in relation to the first aspect are equally applicable for the paver vehicle of the second aspect.

Further features of, and advantages with, the present invention will become apparent when studying the appended claims and the following description. The skilled person realize that different features of the present invention may be combined to create embodiments other than those described in the following, without departing from the scope of the present invention.

BRIEF DESCRIPTION OF THE DRAWINGS

The above, as well as additional objects, features and advantages of the present invention, will be better understood through the following illustrative and non-limiting detailed description of exemplary embodiments of the present invention, wherein.

DETAILED DESCRIPTION OF EXAMPLE EMBODIMENTS OF THE INVENTION

Figure 1:
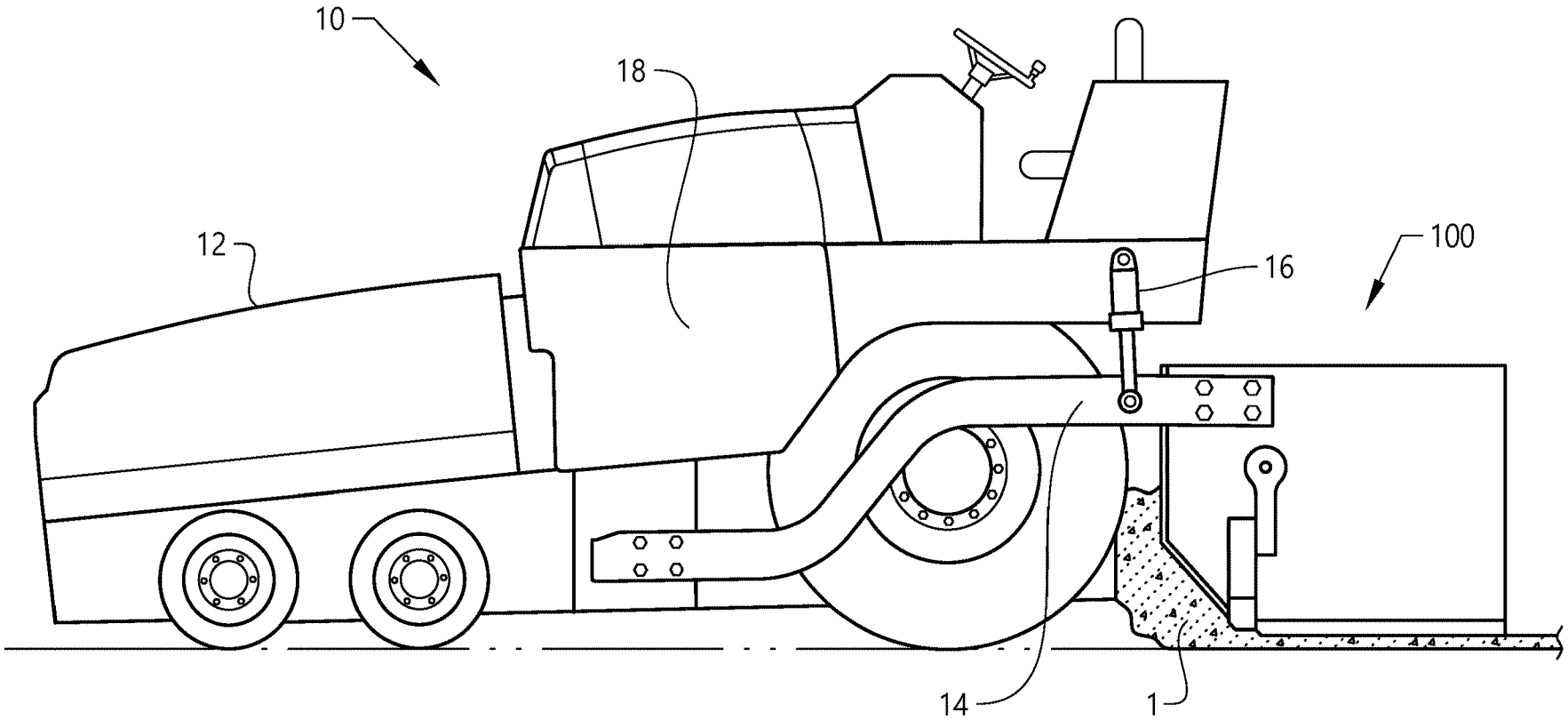
FIG. 1 is a lateral side view illustrating an example embodiment of a vehicle in the form of a paver machine.

The present invention will now be described more fully hereinafter with reference to the accompanying drawings, in which exemplary embodiments of the invention are shown. The invention may, however, be embodied in many different forms and should not be construed as limited to the embodiments set forth herein; rather, these embodiments are provided for thoroughness and completeness. Like reference character refer to like elements throughout the description.

With particular reference to FIG. 1, there is provided a vehicle 1 in the form of a paver machine. The paver machine 1 is arranged to distribute a paving material 1, in the following referred to as asphalt, although distribution of other type of material is also conceivable. The paver machine 10 comprises a hopper 12 into which the asphalt material is provided from e.g. a dump truck. The paver machine 10 further comprises a screed arrangement 100 at a rear end thereof. The screed arrangement 100 is connected to the paver machine 10 by means of a pair of longitudinal extending beams 14 arranged on a respective side of the paver machine 10. The paver machine 1 further comprises a hydraulic cylinder 16 connecting the longitudinal extending beam 14 to the chassis/frame 18 of the paver machine 10. Hereby, the screed arrangement 100 can be moved upwards and downwards relative the chassis/frame 18 of the paver machine 10 by means of controlling the hydraulic cylinder 16.

As the paver machine 10 is driving forward, the asphalt material in the hopper 12 is moved from the hopper 12 to the rear end of the paver machine 10 at a position in front of the screed arrangement 100. The movement of the asphalt material is preferably executed by the use of a suitable conveyor system (not shown). The paver machine 10 thereafter performs initial compacting and distribution of the asphalt material 1 by means of the screed arrangement 100.

Figure 2:
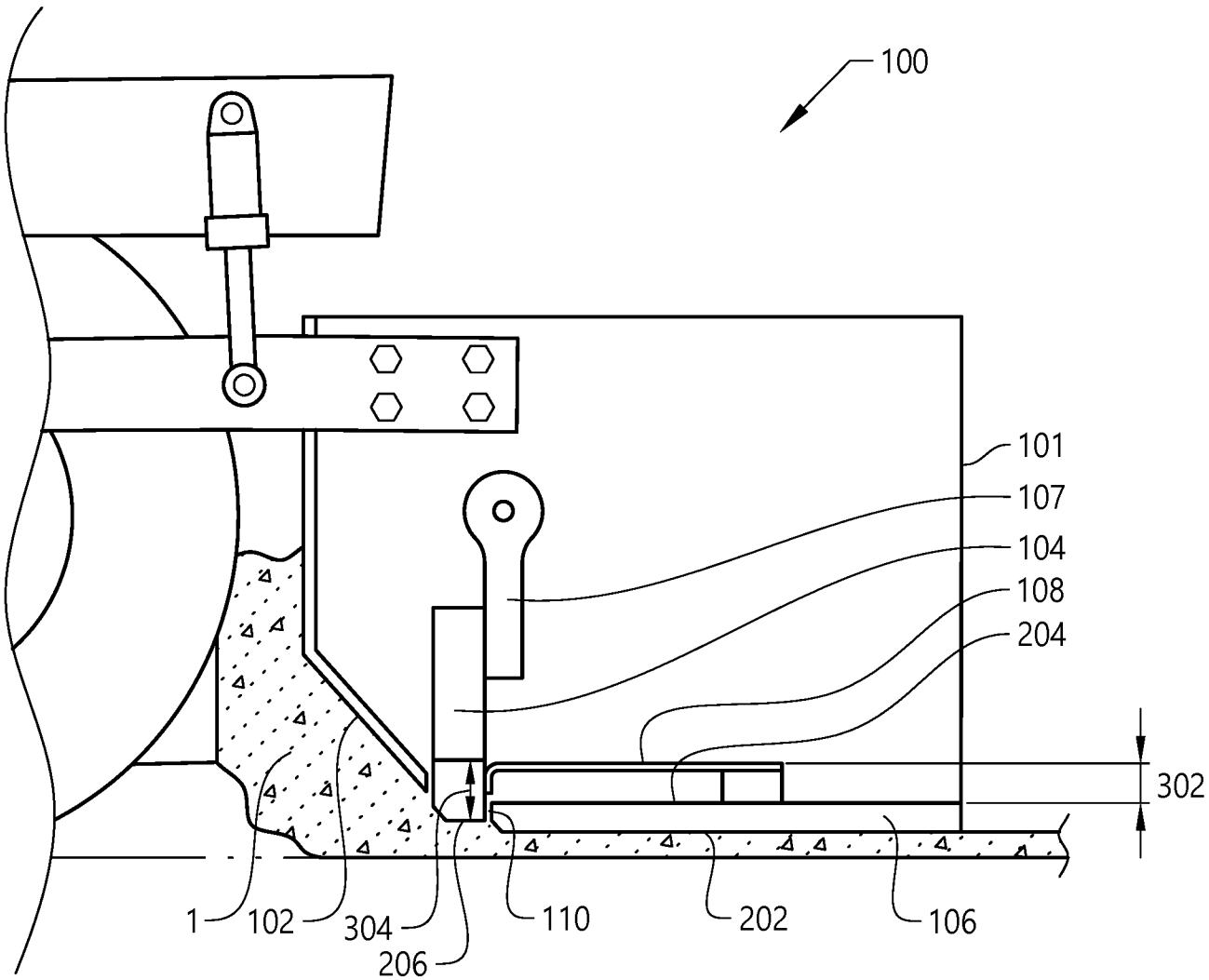
FIG. 2 is a cross-section view of a screed arrangement for the paver machine according to an example embodiment.
Figure 3:
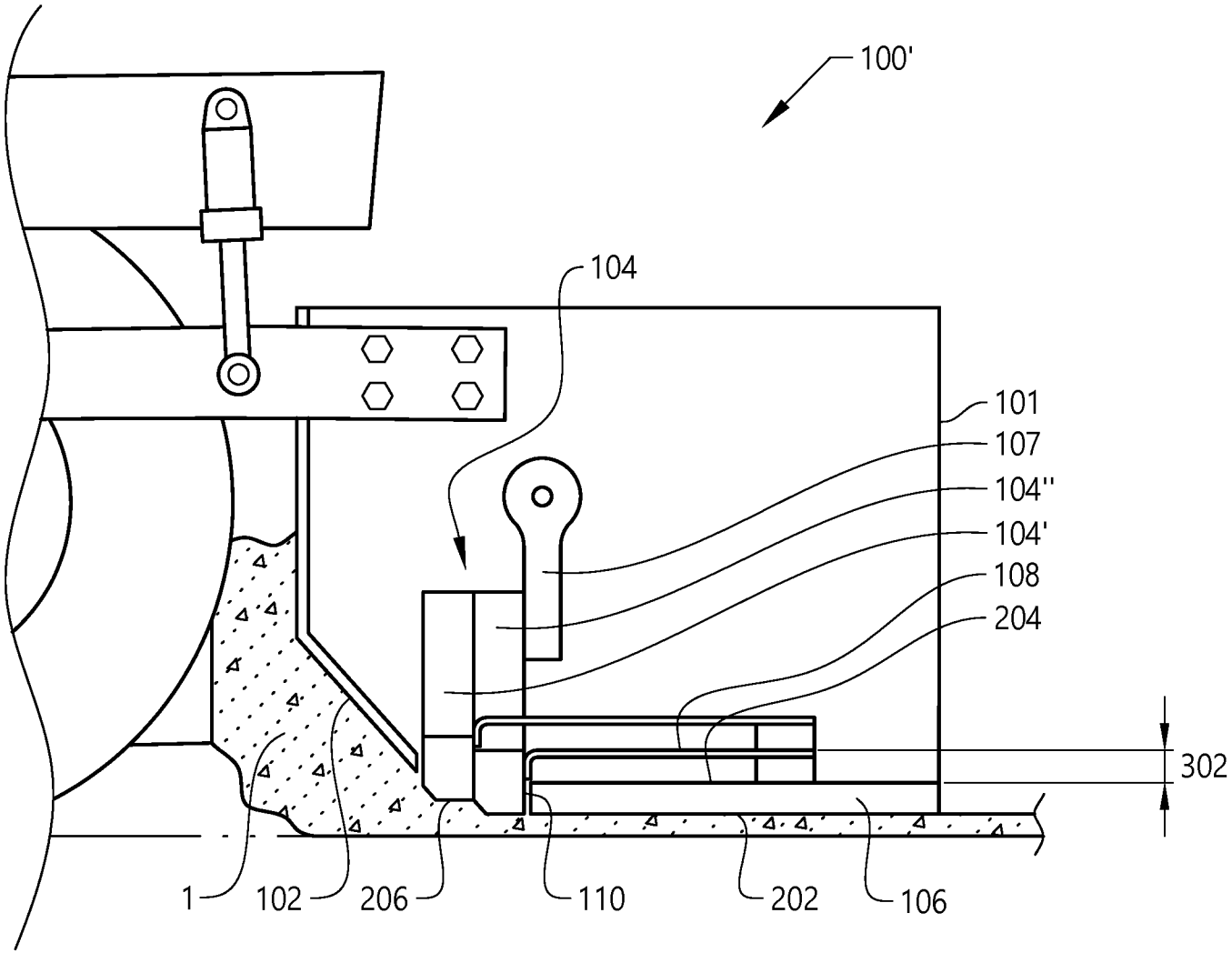
FIG. 3 is a cross-section view of a screed arrangement for the paver machine according to another example embodiment.

In order to describe the screed arrangement 100, and its functionalities in further detail, reference is made to FIGS. 2 and 3, in which FIG. 2 illustrates a first example embodiment of the screed arrangement 100 and FIG. 3 illustrates a second example embodiment.

Reference is thus firstly made to FIG. 2 which illustrates an example embodiment of the screed arrangement 100 of the paver machine 10 in FIG. 1. As can be seen in FIG. 2, the screed arrangement 100 comprises a screed body 101 comprising a deflector member 102, an oscillating tamper bar arrangement 104, and a base plate 106. During operation, the asphalt material is firstly provided to the deflector member 102, which is angled such as to force the material underneath the screed arrangement 100. When the asphalt material 1 is positioned underneath the screed arrangement 100, the oscillating tamper bar arrangement 104 performs initial compacting thereof, where after the asphalt is further compacted and leveled by means of the base plate 106.

The oscillating tamper bar arrangement 104, which in FIG. 2 comprises a single oscillating tamper bar, is positioned in a gap 110 formed between the deflector member 102 and the base plate 106. The oscillating tamper bar arrangement 104 is also connected and operated by an eccentric tappet 107. The eccentric tappet 107 is thus arranged to move the oscillating tamper bar arrangement 104 up and down for initial compacting of the asphalt material. The oscillating tamper bar arrangement 104 thus comprises a compacting surface 206 arranged to compact the asphalt 1 when operating the paver machine. The oscillating tamper bar arrangement 104 may be operated with an oscillating amplitude less than 10 mm, preferably less than 5 mm, and more preferably 3 mm.

During use, the screed arrangement 100 is exposed to a relatively harsh environment. In detail, when driving the paver machine 10 forward and providing asphalt material to the screed arrangement 100, the screed arrangement 100 will be exposed to both vertical and horizontal forces affecting the various components thereof.

Due to these forces, the screed arrangement also comprises a connecting element 108. The connecting element 108 is preferably arranged as a flat spring. The connecting element 108 is connected to the screed body 101 and to the oscillating tamper bar arrangement 104. Preferably, the connecting element 108 is connected to the base plate 106 of the screed body 101. More particularly, the connecting element 108 is connected to a second surface 204 of the base plate 106 facing away from the ground surface and to a position on the oscillating tamper bar arrangement 104 in the vicinity of the gap 110 between the deflector member 102 and the base plate 106. By means of the connecting element 108, a mutual horizontal movement between the oscillating tamper bar arrangement 104 and the base plate 106 is substantially prevented. Also, a mutual movement between the oscillating tamper bar arrangement 104 and the deflector member 102 is also substantially prevented. Hereby, during operation of the paver machine 10, the connecting element 108 prevents the oscillating tamper bar arrangement 104 from contacting the deflector member 102 as well as the base plate 106, whereby rattle in the screed arrangement 100 is reduced. It should however be readily understood that the connecting element 108 should be designed such as to allow the oscillating movement, i.e. the vertical movement, of the oscillating tamper bar arrangement 104 during operation thereof. Hence, the stiffness of the connecting element 108 should preferably be larger in the longitudinal direction in comparison to the vertical direction thereof. A large stiffness in the longitudinal will direct the horizontal forces from the oscillating tamper bar arrangement 104 to the base plate 106.

In order to improve prevention of horizontal movements of the oscillating tamper bar arrangement 104, the connecting element 108 should preferably be connected to the oscillating tamper bar arrangement 104 at a vertical position as close to the second surface 204 of the base plate 106 as possible. According to an example embodiment, the connecting element 108 is connected to the oscillating tamper bar arrangement 104 at a distance 302 to the second surface which is less then 85 millimeters, preferably less than 75 millimeters, and most preferably less than 65 millimeters. However, the position of the connecting element 108 on the oscillating tamper bar arrangement 104 may also be measured from the compacting surface 206 oscillating tamper bar arrangement 104. According to an example embodiment, the connecting element 108 is connected to the oscillating tamper bar arrangement 104 at a distance 304 to the compacting surface 206 which is less than 100 millimeters, preferably less than 85 millimeters, and most preferably less than 75 millimeters. It should however be readily understood that other distances are conceivable and is dependent on e.g. the dimensions of the base plate 106 as well as the oscillating tamper bar arrangement 104.

Reference is now made to FIG. 3 which illustrates the screed arrangement 100 according to another example embodiment. The difference between the screed arrangement 100 in FIG. 2 and the screed arrangement 100' in FIG. 3 is that the oscillating tamper bar arrangement 104 in FIG. 3 comprises dual oscillating tamper bars 104', 104". Hereby, the two oscillating tamper bars 104', 104" are each connected to a respective connecting element in the same manner as described above in relation to the description of FIG. 2.

The connecting element 108 has been described above as a flat, substantially horizontal spring. However, the flat spring may be designed in other shapes as well while still maintaining its intended functionalities. For example, the connecting element 108 may be designed to compensate for components arrange in the vicinity of the base plate. Hereby, the connecting element 108 may be designed as a non-straight connecting element, such as e.g. formed in a C-shaped configuration, or e.g. with a 90 degree radius, etc. The connecting element 108 may also be provided with some enforcing portions for further reducing the risk of buckling during use thereof. Such enforcing portions may for example relate to increased material at specific positions, or by varying the width of the connecting element 108. Other cross-sections than depicted in the figures are also conceivable, such as e.g. a tube shaped or T-shaped cross-section, etc.

It is to be understood that the present invention is not limited to the embodiments described above and illustrated in the drawings; rather, the skilled person will recognize that many changes and modifications may be made within the scope of the appended claims.

The invention claimed is:

1. A screed arrangement for a paver machine, said screed arrangement being configured to distribute a paving material onto a ground surface, wherein the screed arrangement comprises:

a screed body comprising a deflector member arranged to receive and distribute paving material provided from said paver machine, and a base plate for forming an even ground surface of the paving material; and an oscillating tamper bar arrangement positioned between the deflector member and the base plate and configured to compact the paving material; wherein the screed arrangement further comprises a connecting element connecting the oscillating tamper bar arrangement and the screed body to each other, said connecting element being connected to the oscillating tamper bar arrangement in the vicinity of a gap formed between the deflector member and the base plate, wherein the connecting element is arranged in a substantially longitudinal direction between the oscillating tamper bar arrangement and the base plate, wherein a stiffness of the connecting element is larger in the longitudinal direction in comparison to a direction of motion of the oscillating tamper bar arrangement.

2. The screed arrangement according to claim 1, wherein the tamper bar arrangement comprises a compacting surface, which compacting surface is arranged at a lower portion of the tamper bar arrangement and arranged to face the ground surface during use thereof, wherein the connecting element is connected to the tamper bar arrangement at a distance less than 100 millimeters from the compacting surface.

3. The screed arrangement according to claim 1, wherein the stiffness in the substantially longitudinal direction is at least 100 times larger than the stiffness in the direction of motion of the oscillating tamper bar arrangement.

4. The screed arrangement claim 1, wherein the connecting element is a flat spring element allowing a mutual motion between the oscillating tamper bar arrangement and the screed body in a direction of an oscillating movement of the oscillating tamper bar arrangement, while substantially preventing a mutual motion in a longitudinal direction of the flat spring element.

5. The screed arrangement according to claim 1, wherein the oscillating tamper bar arrangement comprises a single oscillating tamper bar.

6. The screed arrangement according to claim 1, wherein the oscillating tamper bar arrangement comprises dual oscillating tamper bars.

7. The screed arrangement according to claim 1 wherein the tamper bar arrangement comprises a compacting surface, which compacting surface is arranged at a lower portion of the tamper bar arrangement and arranged to face the ground surface during use thereof, wherein the connecting element is connected to the tamper bar arrangement at a distance less than 85 millimeters from the compacting surface.

8. The screed arrangement according to claim 1 wherein the tamper bar arrangement comprises a compacting surface, which compacting surface is arranged at a lower portion of the tamper bar arrangement and arranged to face the ground surface during use thereof, wherein the connecting element is connected to the tamper bar arrangement at a distance less than 75 millimeters from the compacting surface.

9. The screed arrangement according to claim 1 , wherein the connecting element is connected to the base plate of the screed body.

10. The screed arrangement according to claim 9, wherein the base plate comprises a first surface that, during use, is arranged to face the ground surface, and a second surface arranged to face away from the ground surface, wherein the connecting element is connected to the second surface of the base plate.

11. The screed arrangement according to claim 10, wherein the connecting element is connected to the tamper bar arrangement at a position in the vicinity of the second surface of the base plate.

12. The screed arrangement according to claim 10, wherein the connecting element is connected to the tamper bar arrangement at a distance less than 85 millimeters from the second surface of the base plate.

13. The screed arrangement according to claim 10, wherein the connecting element is connected to the tamper bar arrangement at a distance less than 75 millimeters from the second surface of the base plate.

14. The screed arrangement according to claim 10, wherein the connecting element is connected to the tamper bar arrangement at a distance less than 65 millimeters from the second surface of the base plate.

15. A paver vehicle arranged to provide a paving material onto a ground surface, said paver vehicle comprising a screed arrangement according to claim 1 for distributing the paving material onto the ground surface.

* * * * *